United States Patent [19]

White et al.

[11] 4,254,450

[45] Mar. 3, 1981

[54] LAMP ASSEMBLY FOR COMBINATION MICROWAVE OVEN AND EXHAUST VENT

[75] Inventors: James A. White, Louisville; Frank L. Rice, Jeffersontown, both of Ky.

[73] Assignee: General Electric Company, Louisville, Ky.

[21] Appl. No.: 935,444

[22] Filed: Aug. 21, 1978

[51] Int. Cl.[3] ..... F21V 33/00; F27D 21/02

[52] U.S. Cl. ..... 362/92; 362/226

[58] Field of Search ..... 362/89, 125–126, 362/92–94, 226, 371, 418, 430, 425; 126/213, 21 A, 299 D, 299 E, 37 R, 37 A, 37 B; 219/10.55, 400

[56] References Cited

U.S. PATENT DOCUMENTS

| | | | |
|---|---|---|---|
| 1,257,128 | 2/1918 | Sheck | 362/430 |
| 1,492,582 | 5/1924 | Smith | 126/37 R |
| 2,010,618 | 8/1935 | Worth et al. | 362/94 |
| 2,275,772 | 3/1942 | Koch | 126/299 D |
| 2,545,508 | 3/1951 | Allen | 362/92 X |
| 2,688,688 | 9/1954 | Holtz | 362/226 |
| 2,754,410 | 7/1956 | Thielorn | 362/226 |
| 3,089,479 | 5/1963 | Perl | 126/21 A |
| 3,180,331 | 4/1965 | Jenn et al. | 126/21 A |
| 3,384,067 | 5/1968 | Rawald et al. | 126/21 A |
| 3,514,577 | 5/1970 | Dills et al. | 219/400 |
| 3,514,578 | 5/1970 | Dills | 219/400 |
| 3,576,417 | 4/1971 | Tingley | 219/10.55 |
| 3,783,219 | 1/1974 | Tateda | 219/10.55 |
| 3,818,171 | 6/1974 | Miller et al. | 219/10.55 |
| 3,973,551 | 8/1976 | Caselani et al. | 126/21 A |
| 4,011,803 | 3/1977 | Pfaffinger | 98/115 K |

OTHER PUBLICATIONS

Ad Brochure by Litton Corp.–Microwave Oven.

*Primary Examiner*—Joseph W. Hartary
*Assistant Examiner*—Thomas H. Tarcza
*Attorney, Agent, or Firm*—Bernard J. Lacomis; Radford M. Reams

[57] ABSTRACT

A lamp mounting assembly for a microwave oven which permits easy replacement of the illuminating lamps including a lamp housing which attaches to the top wall of a microwave oven structure and is located in a space between the top wall of the oven structure and the top wall of a support assembly. The lamp housing is accessible through a removable grille which closes the space at the front of the microwave oven. The top wall of the oven cavity has a series of openings through which light from the bulb is directed to illuminate the oven cavity. The assembly includes supporting sidewalls having elongated channels sloping downwardly from front to rear. The lamp mounting member is supported for reciprocal movement along the channels, the member being accessible through the removable grille.

10 Claims, 5 Drawing Figures

LAMP ASSEMBLY FOR COMBINATION MICROWAVE OVEN AND EXHAUST VENT

BACKGROUND OF THE INVENTION

In typical commercial microwave ovens, a window is included in the oven access door through which the food being cooked may be viewed during the cooking process. In order to brighten the interior of the oven for this purpose, a suitable lamp is usually provided to illuminate the oven cavity either in response to opening the door or in response to the operation of a switch by the oven operator.

One difficulty associated with many such illuminating arrangements is the difficulty of easily replacing the lamp when it fails. More significantly, in situations where a microwave oven is to be located tightly between abutting side and top cabinets, it becomes difficult to provide access to such a lamp for the purpose of replacement. In particular, access to the lamp from the front is limited and difficult to achieve.

OBJECTS AND SUMMARY OF THE INVENTION

It is therefore an object of this invention to provide a lamp assembly which permits easy replacement of the bulb or lamp element.

It is a further object to provide for such lamp replacement by a front accessible opening within easy reach of an oven operator.

A still further object is to provide a lamp assembly which can be attached to an oven operating module as a unit and is separated from the electronics and control compartments of the oven.

These and other objects of the invention are provided by a lamp assembly which is positioned in a space between an oven operating module and a support assembly cover. The lamp assembly is attached as a unit to the module and is located behind a removable grille which covers the front facing opening. The assembly includes a lamp which is held in a reciprocally movable member. In a first position, the member is moved frontwardly to protrude from the space to provide easy access to the lamp. In a second position, the member moves rearwardly and downwardly to bring the lamp adjacent openings in the top wall of the module whereby light therefrom is directed into the microwave oven cavity.

BRIEF DESCRIPTION OF THE VIEWS

The invention will become more readily apparent from the following detailed description taken in conjunction with the accompanying drawings in which.

DESCRIPTION OF THE PREFERRED EMBODIMENT

Figure 1:
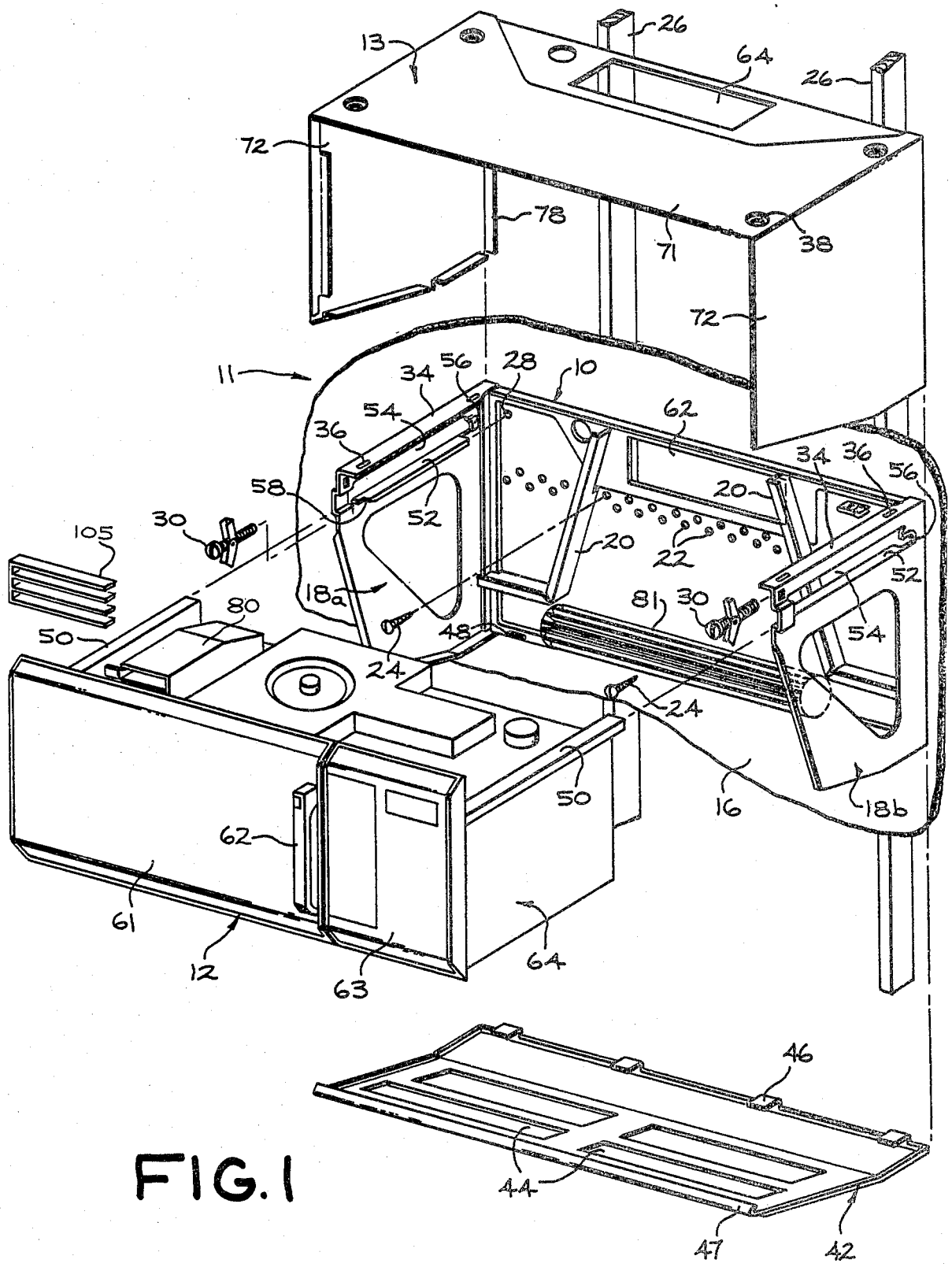
FIG. 1 is an exploded perspective view showing the combination microwave oven and vent assembly with the lamp assembly of this invention assembled thereinto.

Referring to FIG. 1, there is shown an exploded perspective view of the microwave oven assembly into which the improved lamp mounting assembly 80 of the invention is incorporated. The overall microwave oven assembly shown in FIG. 1 is described in detail in currently filed, commonly assigned application Ser. No. 935,433, filed in the joint names of James A. White and Frank L. Rice, entitled COMBINATION MICROWAVE OVEN AND EXHAUST VENT AND INSTALLATION MOUNTING METHOD THEREFOR, which disclosure is hereby incorporated by reference. Only a brief description of the overall construction of the oven assembly will be given here for the sake of clarity, and to form a background for understanding the lamp assembly of this invention.

The microwave oven assembly comprises a support assembly 11 which supports a microwave oven operating module 12. The support assembly 11 includes a main support member 10, a cover member 13 and a bottom closure 42 which jointly form an open-sided enclosure into which an oven module 12 is slidably inserted.

The main support member 10 provides essentially the entire support for the arrangement, and for this purpose is constructed of a relatively heavy gauge sheet metal. The main support member 10 includes a back wall 14, adapted to fit substantially flush against a conventional wall board 16 and a pair of appliance supporting integral sidewalls 18*a* and 18*b*. The back wall 14 has a rectangular opening 62 to provide a vent path out of the assembly along the back thereof, the opening 62 being either blocked by a suitable covering piece (not shown) or brought into air communication with a range exhaust flue or conduit for venting to the exterior.

The back wall 14 contains on its interior surface a pair of raised walls or ribs 20 for enhancing the strength and rigidity thereof. The ribs also perform the function of directing exhaust air through the structure, as described in greater detail in concurrently-filed and commonly assigned application Ser. No. 935,936, in the joint names of James A. White, Frank L. Rice and Walter E. Lewis, and entitled VENTILATION SYSTEM FOR COMBINATION MICROWAVE OVEN AND EXHAUST VENT, which disclosure is hereby incorporated by reference.

Multiple rows of holes 22 extend across the back wall 14 through selected ones which at least one lag screw 24 or other suitable threaded fasteners can be inserted to securely mount the assembly to the wall board 16 and to at least one wall support member or stud 26. A pair of holes 28 located in the upper right and left hand corners of the back wall 14 permits the main support member 10 to be further secured to the wall board 16 with suitable fasteners such as a pair of toggle bolts 30.

In order to provide support for the oven module 12 when inserted into the support assembly, the sidewalls 18*a* and 18*b* have formed thereon a pair of rails 52. The rails 52 are formed by punching out and bending inwardly an elongated piece of sheet metal, the openings 54 resulting from this process. The rails 52 extend front to rear across substantially the entire depth of the sidewalls 18*a* and 18*b*.

The sidewalls 18*a* and 18*b* on the support member 10 are provided with inwardly directed flanges 34, the latter flanges having a plurality of slots 36 formed therein adjacent the four corners of the member 10.

These openings are used in combination with similar holes 38 in the cover 13 to couple the support assembly to an overhanging cabinet.

The cover 13 is generally inverted U-shaped member formed from a relatively light gauge of sheet metal comprising arms 72 which extend downwardly at right angles away from a base or central portion 71. The base 71 is provided with a set of openings 38 which are aligned with the set of slots 36 in the member 10 so that suitable fasteners, such as screws 40, may be inserted therethrough to attach the assembly including the cover 13 and support member 10, to an overhead cabinet. The cover 13 is positioned over the member 10 so that the arms 72 thereof straddle the sidewalls 18*a* and 18*b* on the outside thereof. Aligned holes (not shown) are provided in cover 13 and member 10 through which screws may be inserted to hold these pieces together. The exterior or outside faces of the cover 13 are finished in a conventional manner to provide an acceptable pleasing outward appearance for the arrangement.

The microwave oven module 12 comprises a unitary structure having a generally box-like appearance. The module 12 includes a frontwardly swingable door 61 (shown in its closed position), which is hingedly supported at the left side thereof and openable by means of a handle 62. A cooking cavity (not shown) is formed behind the door and is generally rectangular in cross-section. The oven module is provided with a control panel 63 which has operator controls for controlling the oven and hood functions (i.e., power, temperature, blower, etc.), as is conventional in the art. The oven module also incorporates a magnetron (not shown) for generating microwaves at a predetermined frequency and waveguides for delivering the microwaves into the interior of the cooking cavity. The construction of the basic operating features of the oven is conventional, and reference may be had to numerous patents in the prior art for detailed information thereon.

The module 12 is generally composed of a sheet metal body 64 in accordance with concurrently-filed and commonly assigned application Ser. No. 935,445, in the name of James A. White, entitled UNITIZED OVEN STRUCTURE FOR A MICROWAVE OVEN, which disclosure is also incorporated hereinto by reference. That application may be referred to for details of construction for the sheet metal unitized body, which forms no part of this invention, and the details of which are being omitted for the sake of brevity. The sheet metal body 64 has a top wall 65 which is turned upwardly and outwardly at the sides thereof to form two flanges or ledges 50 which define a pair of channels extending front to rear along substantially the entire depth of the module. The channels defined by the flanges 50 interfit over the rails 52 to thereby permit sliding support of the module 12 on the rails 52.

The main support member 10 also has suitable formations for supporting an exhaust fan assembly (FIG. 1) including a fan 81 located centrally of the member 10 and in air communication with the closure plate 42. The fan assembly is attachable to the support member 10 prior to insertion of the module 12.

A panel or closure plate 42 serves to close off the bottom wall of the support assembly. The plate 42 includes tabs 46 along the rear edge thereof which interfit with slots 48 along the lower edge of the back wall 14. The front edge of the cover plate 42 has an inwardly turned lip 47 which resiliently cooperates with a mating formation on the lower front edge of the module 12 to hold the front of the plate 42 in place. The plate 42 is provided with appropriate rectangular vent openings having air intake filters 44 positioned therein. The base plate 42 may also be provided with a translucent panel 49 above which light-emitting means (not shown) may be positioned to illuminate the range heating surface located below the oven. Above the plate 42 and below the module 12 there is created an intake plenum with the filters 44 acting as intake ports for the plenum.

The oven is assembled by joining the cover 13 and plate 42 to the support member 10 which results in a support assembly or enclosure closed on the top, rear, sides and bottom, but open at the front. The module 12 is then slid rearwardly into the enclosure along rails 52 until the rear wall of the module abuts the ribs 20.

Figure 5:
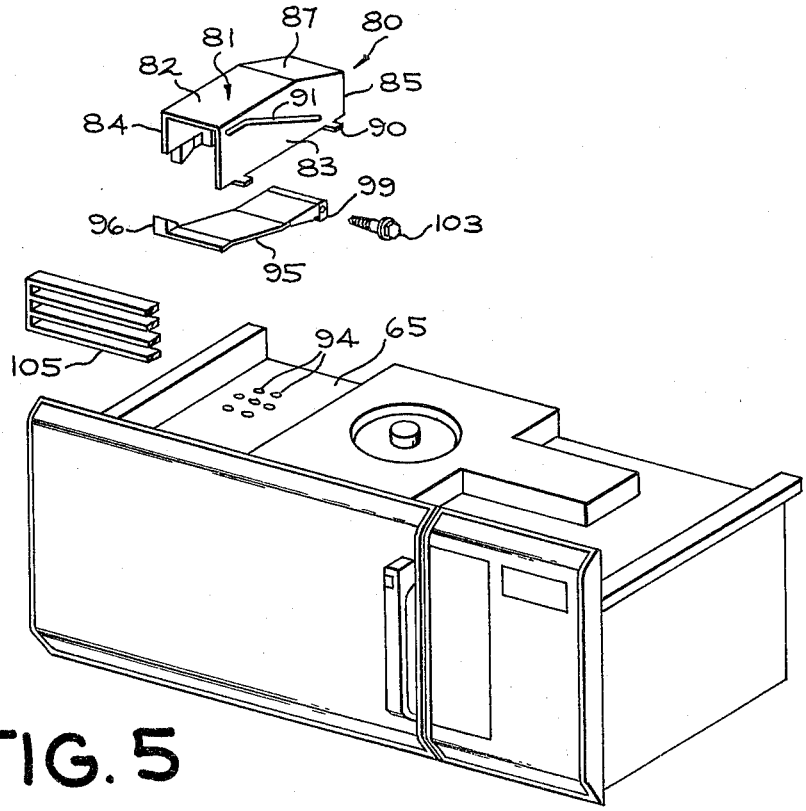
FIG. 5 is a perspective view of the oven module with the lamp mounting assembly displaced above the module.

It should be noted that when the module 12 is positioned within the support assembly thus formed, a space is created between the top wall 71 of the cover 13 and the top wall 65 of the oven module 12. It is in this space that the lamp mounting assembly 80 of the invention resides, as can be visualized by examination of FIGS. 1 and 5.

The lamp assembly 80 is seen to comprise a housing 81 including a top wall 82, sidewalls 83, 84, and rear wall 85. The top, side and rear walls form an integral piece which is preferably made of molded plastic and form an enclosure closed at the top, sides and rear, but open on the bottom and front. The top wall has a front portion 82 which is generally horizontal and a sloping rearward portion 87 which extends from the rearmost end of portion 82 to the rear wall 85.

The sidewalls 84 and 83 are generally vertical and include outwardly extending flanges 89 having tabs 90 in which holes are formed (not shown), the latter holes permitting attachment of the lamp assembly 80 to the top wall 65 of the oven sheet metal structure 64. The top wall 65 is provided with holes 94 directly below the lamp housing 80 which communicate with the interior of the oven and through which light from the assembly 80 passes to illuminate the interior of the oven cavity.

The sidewalls 84 and 83 are provided with a pair of channels 91 which run from front to rear of the assembly 80. The channels 91 include a horizontal portion 93 and a sloping portion 92 which descends downwardly front to rear. The descending portion 92 terminates in an area adjacent the holes 94 in the oven cavity.

A lamp mounting member 95 is slidably supported for reciprocal movement along the channels 91. The member 95 comprises a generally rectangular metal piece having a positioning tab 96 formed on the front thereof which may be manually grasped to move the member 95. A terminal box 99 is provided on the rear end of the member 95 from which a socket 101 extends toward the front. Any suitable bulb 102 may be inserted into the socket 101. The terminal box 99 has suitable openings (not shown) through which electrical leads or wires (not shown) may extend to provide an electrical voltage for operation of the bulb. The top interior surface 108 of the member 95 (facing the bulb 102) may be painted white or made from a suitable light-reflective material to direct the greatest amount of light from the bulb through the openings 94 into the oven cavity.

A pair of shoulder screws 103 pass through channels 91 into threaded openings in the sidewalls of the terminal box 99. Because the heads of the screws 103 are larger than the width of the channels 91, the screws are captured therein and serve to support the member 95 in its reciprocal movement within the housing 81.

As mentioned previously, with the module 12 assembled into the support assembly, a space is created between the surface 71 of the cover 13 and the top wall 65 of the module 12. An air permeable grille 105 is provided for mounting over the front access to this space. The grille 105 is mounted by means of screws or other suitable fasteners which pass through openings in the grille (not shown) and corresponding aligned openings in the module and the support assembly member 10.

Figure 3:
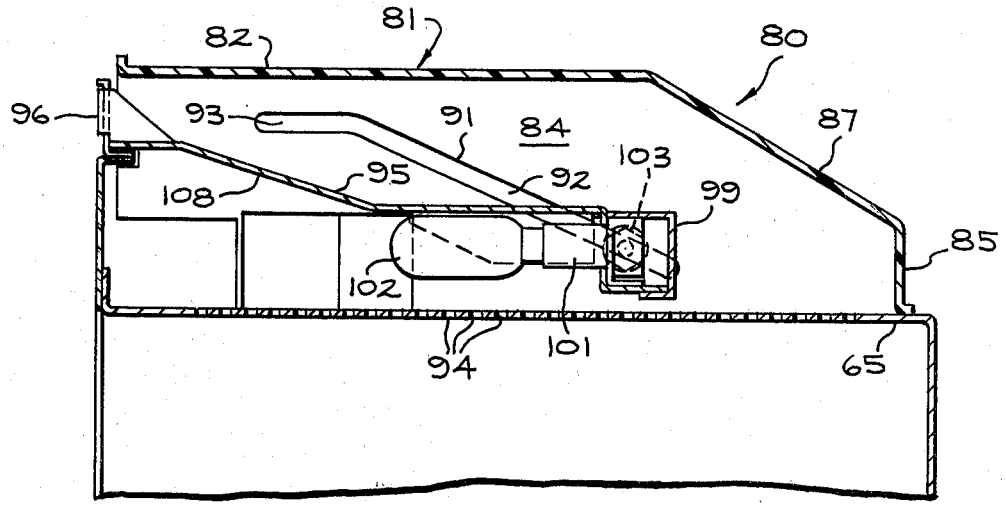
FIG. 3 is an elevational view showing the lamp assembly with one side wall omitted to reveal the details of the assembly in its rearwardmost position.

Referring to FIG. 3, when the member 95 is in its rearward position, the bulb 102 is closely adjacent the holes 94 in the oven cavity and light from the bulb is directed into the oven cavity.

Figure 2:
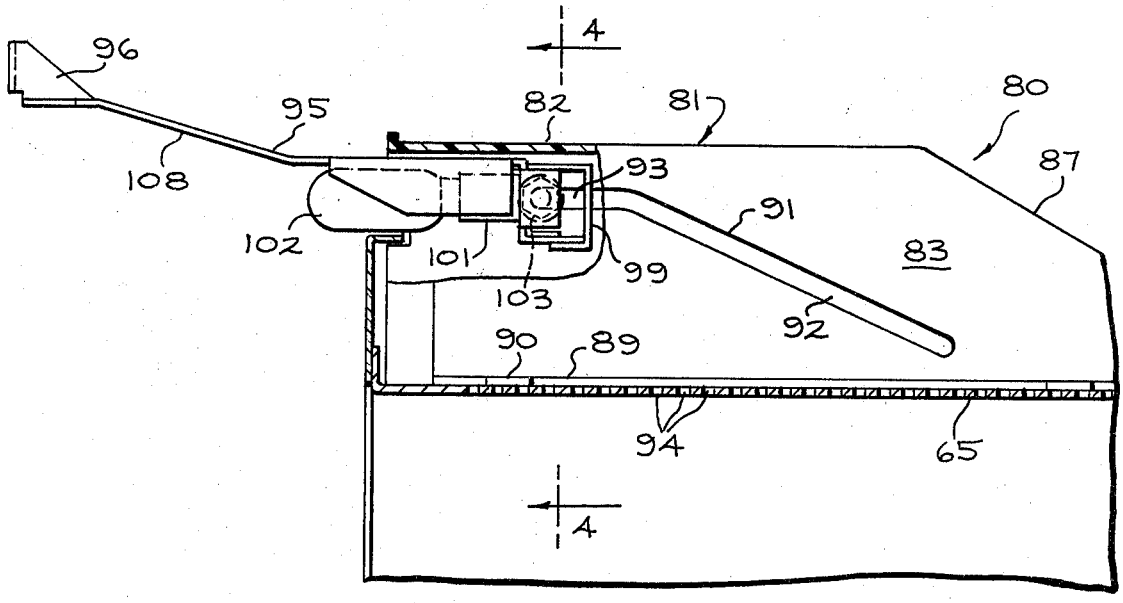
FIG. 2 is an elevational view of the lamp assembly with the housing partly broken away to show the lamp in its forwardmost position.
Figure 4:
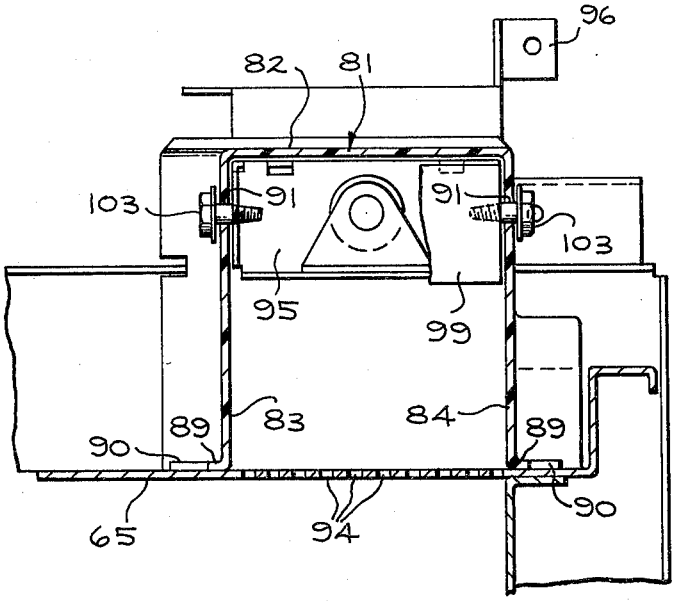
FIG. 4 is a view taken along line 4—4 of FIG. 2.

When it is desired to change the bulb 102, the operator removes the covering grille 105, manually grasps the tab 96 and withdraws the member 95. As the member 95 is moved forwardly toward the oven door, the screws 103 ride in the channel 91 resulting in an upward and forward movement of the bulb 102 to a position shown in FIG. 2. At this position, the bulb may be easily removed and replaced and the member 95 returned to its rearward position. It should be noted that rearward movement of the member 105 is limited by abutment between the sidewalls 84 and the back surface of tab 96, while forward movement of the member is limited by abutment of the screws 103 with the forward end of the channel.

Although the subject invention has been described with respect to specific details of a certain preferred embodiment thereof, it is not intended that such details limit the scope of the present invention otherwise than as set forth in the following claims.

What is claimed is:

1. A microwave oven appliance comprising:

a microwave oven operating module including a magnetron housing, an oven cavity, a front opening door for providing access to said cavity;

a support assembly in which said module is supported, said module adapted for movement into and out of said assembly, said assembly including a wall spaced from said module to provide a front accessible space therebetween formed by insertion of said module into said assembly; and a lamp assembly positioned in said space, said lamp assembly including a lamp and means for reciprocally mounting said lamp for movement between a first position in which it illuminates said cavity, and a second position out of said space in which it is manually accessible for removal and replacement, movement between said first and second positions transversing a path generally perpendicular to the plane of said door.

2. The combination recited in claim 1 wherein said lamp assembly is carried by said module and includes upright sidewalls spaced from each other, said sidewalls having channels running parallel to each other, and a lamp holding member supported for sliding movement along said channels.

3. The combination recited in claim 2 wherein said channels slope downwardly toward said module as said member moves rearwardly away from said door.

4. The combination recited in claim 2 further including a detachable grille covering said space.

5. A microwave oven appliance comprising:

a microwave oven operating module including a magnetron housing, an oven cavity, a front opening door for providing access to said cavity;

a support assembly comprising a generally open-front, wall mountable enclosure in which said module is supported, said module and assembly having cooperating means to permit movement of said module into and out of said assembly, a space formed generally between the top wall of said assembly and said module, said space being accessible from the front of said appliance and running rearwardly; and a lamp assembly carried by said module and positioned in said space, said lamp assembly including a lamp and means manually accessible from the front of said appliance for reciprocally mounting said lamp for movement between a first rearward position in which it illuminates said cavity, and a second forward position in which it is manually accessible for removal and replacement from the front of said appliance.

6. The combination recited in claim 5 wherein said lamp assembly includes upright sidewalls spaced from each other, said sidewalls having channels, and a lamp holding member supported for sliding movement along said channels.

7. The combination recited in claim 6 wherein said channels slope downwardly toward said module as said member moves rearwardly away from said door.

8. The combination recited in claim 7 further including a detachable grille covering said space.

9. The combination recited in claim 6 wherein said holding member comprises a plate having a light-reflecting surface, said lamp positioned between said surface and said cavity, said module including an aperture through which light from said lamp passes to said cavity.

10. The combination recited in claim 1 wherein said lamp in moving between said first and second positions transverses a path generally perpendicular to the plane of said door.

* * * * *